US006443792B1

(12) United States Patent
Forti et al.

(10) Patent No.: US 6,443,792 B1
(45) Date of Patent: Sep. 3, 2002

(54) MECHANICALLY LAUNCHED MONOWING TOY

(76) Inventors: William Mark Forti, 112 N. Harvard, #229, Claremont, CA (US) 91711; William B. Forti, 112 N. Harvard, #229, Claremont, CA (US) 92835

( * ) Notice: Subject to any disclaimer, the term of this patent is extended or adjusted under 35 U.S.C. 154(b) by 0 days.

(21) Appl. No.: 09/427,884

(22) Filed: Oct. 26, 1999

(51) Int. Cl.[7] ..... A63H 27/00
(52) U.S. Cl. ..... 446/61; 446/63
(58) Field of Search ..... 446/61, 63, 68, 446/67, 46, 49, 45

(56) References Cited

U.S. PATENT DOCUMENTS 1,420,193 A * 6/1922 Howard
2,298,425 A * 10/1942 Schaffer
2,932,124 A * 4/1960 Robinette
3,113,398 A * 12/1963 Merritt
3,949,519 A * 4/1976 Meyer
4,836,817 A * 6/1989 Corbin ..... 446/62
5,013,277 A * 5/1991 Hufeld ..... 446/61
5,176,559 A * 1/1993 Lane ..... 446/68
5,240,448 A * 8/1993 Ishikawa ..... 446/61
5,281,179 A * 1/1994 Wu ..... 446/68
5,505,650 A * 4/1996 Harned ..... 446/61
5,741,168 A * 4/1998 Chen ..... 446/66

* cited by examiner

*Primary Examiner*—Sam Rimell
(74) *Attorney, Agent, or Firm*—Rutan & Tucker, LLP; Robert D. Fish

(57) ABSTRACT

A flying toy has a wing having a leading edge, a first end, and a second end. A ballast element is coupled to the first end of the wing, and a launcher receiver element that receives a launcher is coupled to the ballast element.

17 Claims, 2 Drawing Sheets

MECHANICALLY LAUNCHED MONOWING TOY

FIELD OF THE INVENTION

The field of the invention is flying toys.

BACKGROUND OF THE INVENTION

Flying toys are popular for individuals in many age groups, and various flying toys are known in the art. While some of the flying toys are self-propelled, and may even take off and land from a miniature airstrip, most of the common flying toys must be launched by a player. Depending on the size and mode of flight, the flying toy is either hand-launched or mechanically launched in the air.

Most hand-launched toys, including Frisbees and toy gliders, typically exhibit a more or less linear flight path, and the construction or assembly of the flying toy is often more exiting than the actual flying of the toy due to the toy's mostly uniform and predictable flight behavior. A smaller number of hand-launched toys exhibit a more interesting flight path. For example, a boomerang will have various flight characteristics depending on the wind conditions, variations in ballast in the tips of the wing, the profile of the wings, etc. However, throwing a boomerang typically requires some degree of skill and physical strength, and therefore tends to be limited to more grown-up players. To overcome at least some of the problems associated with boomerangs, J. Atkielski teaches in U.S. Pat. No. 4,541,637 an improved light-weight boomerang which returns approximately to the point from which it is thrown, and which does not require a high degree of skill on the part of the player to be thrown properly. However, even such a 'user-friendly' boomerang requires at least some degree of dexterity, and may still be challenging to launch for some players.

Another example for a hand-launched toy with non-linear flight path is shown in U.S. Pat. No. 5,505,650 to W. D. Harned, in which an auto-rotating toy is described, which simulates a maple seed in appearance and flight characteristics. In a game employing the auto-rotating toy, scoring targets are randomly distributed on the ground, a player throws the toy in the air, and receives a score when the auto-rotating toy lands close to, or on a scoring target. However, to achieve an auto-rotating motion of the toy, the player typically must throw the toy with a certain vigor, which may either significantly limit the group of likely players, or limit the excitement of players who are not able to propel the toy with sufficient force.

To help players in launching a flying toy more forcefully, mechanical launchers have been employed. Mechanical launchers typically generate more excitement due to the relatively rapid speed at which the toy is projected from the launcher, and the higher climbing altitude that may be reached by the toy. For example, in U.S. Pat. No. 4,183,168 to R. E. Ross, a flying disk toy is described, in which a hand crank provides rotational acceleration, resulting in a vertical movement (i.e. launching) of the toy. Although the hand crank may produce a relatively fast spin of the disk toy, not all rotational energy is translated into the propulsion of the toy, thereby slowing down the launch. Moreover, when not handled with sufficient care, the disk tends to become deformed and thereby less likely to ascend to high altitude.

In another example, U.S. Pat. No. 3,839,818 to E. J. Heggedal, the inventor describes a glider plane with retractable wings, which is launched in a folded configuration. When the folded glider reaches the apogee of its ascend, the wings unfold, and the glider slowly descends. The retractable wings advantageously allow launching the glider at a comparably high speed, however, retrieving the glider may become especially problematic when the glider reaches substantial altitude. Due to the linear, and after launch unalterable flight path, the glider may fly out of reach, or turn in an undesired direction.

Although various mechanically launched flying toys are known to the art, all or almost all of them suffer from one or more disadvantage. Therefore, there is a need to provide apparatus and methods for improved mechanically launched flying toys.

SUMMARY OF THE INVENTION

The present invention is directed to a flying toy that has a wing with a leading edge, a first end, and a second end. A ballast element is coupled to the first end of the wing, and a launcher receiver element to receive a launcher is coupled to the ballast element.

In one aspect of the inventive subject matter, the flying toy has a shape that resembles that of a giant pericarp of a maple seed, and the wing is preferably fabricated from paper, more preferably from a synthetic polymer, and most preferably from a textile material. The wing has preferably a straight leading edge, and may further comprise additional stabilizing elements.

In other aspects, the ballast element is non-spherical, and preferably tear-shaped with an indentation. It is also preferred that the ballast element is separable in a top portion and a bottom portion, and that the wing is disposed between the top and bottom portions.

In a further aspect of the inventive subject matter, the launcher receiver element is mounted within an indentation in the ballast element, and preferably comprises a hook. The ballast element and launcher receiver element are positioned on the wing such that the leading edge is substantially vertical when the flying toy is suspended from the launcher receiver element.

Various objects, features, aspects and advantages of the present invention will become more apparent from the following detailed description of preferred embodiments of the invention, along with the accompanying drawings in which like numerals represent like components.

DETAILED DESCRIPTION

Figure 1:
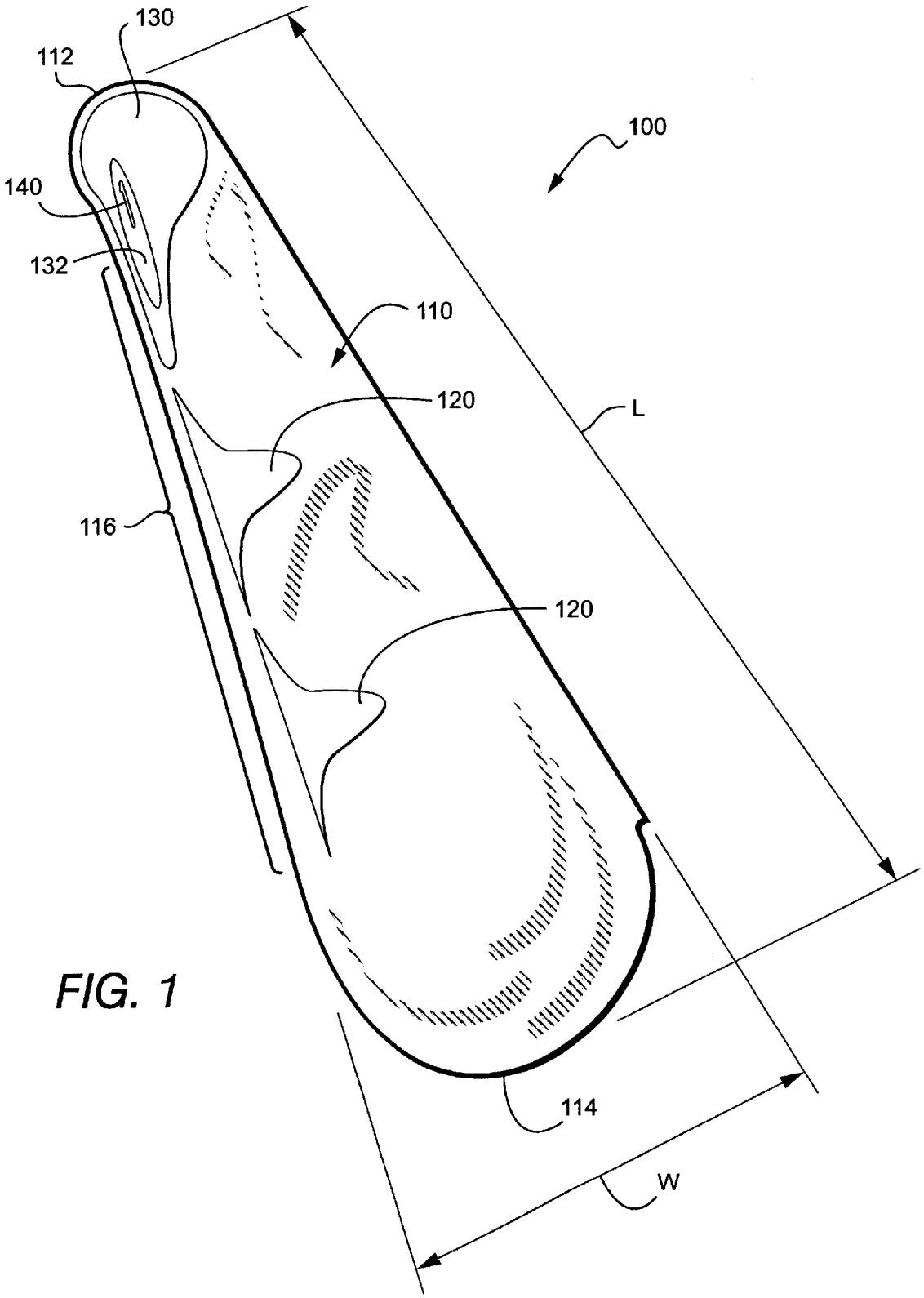
FIG. 1 is a top view of a flying toy according to the inventive subject matter.

Turning now to FIG. 1, an exemplary maple seed-shaped flying toy 100 is shown having a wing 110 with a first end 112, a second end 114, and a leading edge 116. Stabilizing elements 120 are situated on the first or second side of wing 110. A ballast element 130 is coupled to the wing 110, and has an indentation 132 in which a launcher receiving element 140 is disposed.

In a preferred embodiment, the wing 110 of the flying toy is fabricated from a cotton cloth, and has an overall length of about 25 cm, and at the widest point a width of about 7 cm with the first end of the wing 112 being smaller than the second end of the wing 114. The leading edge 116 is straight and reinforced with a copper wire of approximately 2 mm diameter and a length of about 20 cm. Glued to the top side of the wing are two polystyrene triangles as stabilizing elements with a side length of approximately 5 cm and a thickness of about 1 mm. The ballast element 130 is fabricated from injection molded polystyrene in a tear drop shape with an overall length of approximately 6 cm and an overall width of about 2.5 cm. The ballast element is separable in a top portion and a bottom portion, whereby both portions have a corresponding flat surface. Top and bottom portions are glued to the top and the bottom of the wing, respectively, such that the flat surface of the top and bottom portions of the ballast element are placed on top of each other. The top portion of the ballast element 130 has an indentation 132 of approximately 4 cm length, about 0.5 cm width and about 0.5 cm depth, wherein the indentation runs substantially parallel to the leading edge 116. Nailed into the middle of the indentation of the ballast element is an L-shaped hook 140. The ballast element and the launcher receiver element are positioned on the wing such that the leading edge is substantially vertical when the flying toy is suspended from the launcher receiver element.

In alternative aspects of the inventive subject matter, the wing may also be fabricated from various materials other than cotton cloth, including textiles, synthetic polymers, paper, and paper products. For example, when flexibility is particularly desired, textile material may be advantageously utilized, while a more sturdy flying toy may have a wing manufactured from synthetic polymers, including polyethylene, polyvinyl chloride, and polycarbonate. Furthermore, synthetic polymers have the advantage that they are usually weather- and tear resistant. However, construction and assembly of the flying toy at home may be simpler when cardboard or paper is employed as the material for the wing. Paper and especially silk paper are lightweight materials and may therefore give the toy an extended airtime. However, paper tends to lose firmness and shape when it becomes wet, and may consequently be limited to indoor, or fair weather use only.

It should also be appreciated that the wing may or may not have the shape of an airfoil, wherein shaping of the wing may be achieved by various methods, including addition or removal of wing material, or temporary or permanent deformation of the wing. For example, when the wing material is a paper or cardboard, it is contemplated that additional paper strips may be glued or otherwise affixed to the front end of the wing, whereas when the wing is formed from wood, an airfoil may be shaped employing a file and/or sandpaper. Flexible wing material, including textiles and synthetic polymers, may be given an airfoil shape by bending and affixing the wing to preformed elements. Such wing-shaping elements may include wire, synthetic polymers, or other relatively non-pliable material, and may advantageously function as a stabilizing element. It is contemplated that a wing having the shape of an airfoil may generate lift, and therefore enhance the flight characteristics of the flying toy, including time of flight, speed of rotation, maximum height, etc.

Many sizes are contemplated for alternative flying toys according to the inventive subject matter, and appropriate sizes need not be restricted to a length of about 25 cm, and a width of about 7 cm at the widest point. Contemplated sizes include lengths of between about 5 cm to 100 cm, and a flying toy is contemplated wherein the wing has a length L and a width W, wherein the ratio of L to W is between 10:1 and 3:1. While relatively small flying toys may be especially useful for playing indoors, larger toys may generate more excitement because larger flying toys may be launched to greater heights. It is also contemplated that with increasing size of the toy, launching may require more power. Therefore it is contemplated that flying toys for smaller children may have a smaller wing size of about 5 cm or less to 25 cm, while flying toys for older or stronger players may have a wing size of 25 cm to 100 cm, and more.

It should further be appreciated that higher altitudes may generally be achieved with increasing length to width ratios. For example, a toy with a length to width ratio of about 4:1 will have a lower climbing altitude than a toy with a length to width ratio of about 7:1. However, lower lengths to width ratios typically promote a faster spinning of the flying toy, and depending on the desired flight characteristics, various length to width ratios are considered appropriate.

Although the leading edge is preferably reinforced with a copper wire, alternative flying toys may have various reinforcements other than a copper wire. For example contemplated reinforcements include synthetic polymers, natural products, and paper. The choice of reinforcing material is typically dependent on the desired quality of the reinforcement. Especially contemplated metals include aluminum, titanium, iron alloys, etc., and in cases where low weight is especially desirable, a thin metal rod, pipe, or stripe may be employed. In other cases where flexibility of the leading edge is required, elastic materials, including soft plastics such as polyethylene, polyvinyl chloride, etc. are contemplated. It should further be appreciated that the leading edge need not necessarily be straight, but may also have alternative shapes, including rounded and jagged shapes. Likewise, although the first and second ends of the wing are preferably non-identical, it is contemplated that first and second ends of the wing may also be identical.

With respect to the stabilizing elements it is contemplated that various elements other than polystyrene triangles are appropriate, wherein alternative stabilizing elements may include elements that are formed from the wing material, and additionally added elements to the wing. Stabilizing elements that are formed from the wing material may advantageously simplify the manufacture, and may reduce the number of parts required to produce the toy. For example, excess wing material may be folded over and glued along the leading edge. Alternatively, stabilizing elements may be cut from the raw material in a desired form and subsequently sewed, or otherwise affixed to the wing surface. While utilizing wing material for the stabilizers may reduce cost or assembly time, the characteristics of the stabilizers are concomitantly limited to the particular characteristics of the wing material. If different characteristics from the wing material are desired, it is contemplated that the stabilizers may be fabricated from various non-wing materials. The choice of material is not limiting to the inventive subject matter, and alternative materials may include metals, natural and synthetic polymers, and textiles. When ruggedness is preferred, polymers are especially contemplated, including polyethylene, polyvinyl chloride, and polycarbonate, etc. On the other hand, flexibility may be imparted by employing materials, including rubber, while form-giving stabilizers may advantageously be manufactured from metals or metal alloys, such as aluminum, copper, iron, stainless steel, etc. It should also be appreciated that the method of affixing the stabilizing elements is not critical to the inventive concept presented herein. Thus, various methods other than gluing the stabilizing element to the wing are contemplated, including affixing the stabilizer with hook-and-loop fasteners, bolting, sewing, inserting in a preformed pouch, etc. Similarly, the number and shape of the stabilizing elements predominantly depends on the wing material, and the material from which the stabilizing elements are manufactured. Contemplated flying toys may therefore have 1–10 stabilizing elements, or even more.

Figure 2A:
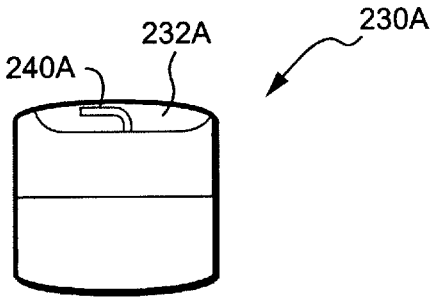
FIGS. 2A–C are side views of alternative ballast elements according to the inventive subject matter.
Figure 2B:
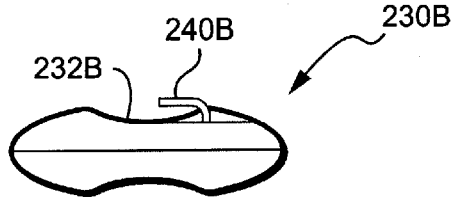
Figure 2C:
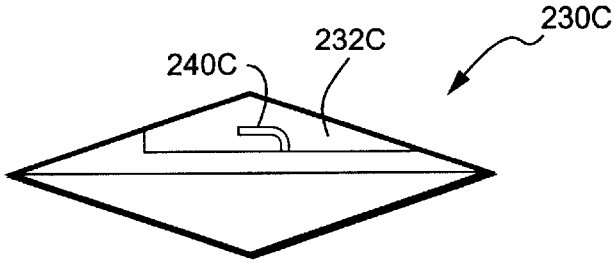

In further aspects of the inventive subject matter, the shape of the ballast element need not be limited to a teardrop, and alternative shapes may include rectangular, ellipsoid, spherical, cylindrical, or pyramidal forms. Various exemplary alternative ballast elements are shown in FIGS. 2A–C, wherein FIG. 2A depicts a ballast element 230A with an indentation 232A, and a launcher receiving element 240A. FIGS. 2B–C show further exemplary alternative ballast elements, wherein like numerals refer to like features. With respect to the size of alternative ballast elements it is contemplated that the size of the ballast element is appropriate for the size of the wing, and is at least in part a function of the density of the material employed for the ballast element. Thus, contemplated ballast elements may be as small as a few millimeters in their longest dimension. However, especially when a lightweight material is utilized for the ballast element, appropriate ballast elements may also extend along the entire wing.

Although the preferred ballast element is separable in a top portion and a bottom portion that are glued to the top and bottom of the wing, respectively, alternative ballast elements need not be limited a ballast element that is separable in a top and bottom portion. For example, it is contemplated that appropriate ballast elements may have a slot to accommodate the wing. The wing may thereby be temporarily or permanently affixed to the ballast element. When disassembling of the wing and ballast element is desirable, the wing may advantageously be attached with dowels, screws, or a hook and loop-type fastener, allowing repair, or even replacement of the wing or ballast element without the need to manufacture or purchase a new flying toy. Alternatively, a permanent connection may render the coupling more stable than a temporary link, and contemplated connections between wing and ballast element may include glue, or bolts.

It should further be appreciated that alternative ballast elements need not be fabricated from injection molded polystyrene, and various appropriate materials are contemplated, including metals, natural and synthetic polymers, and any reasonable combination thereof. The choice of material for an alternative ballast element is predominantly dependent on the desired density and processibility. For example, in a mass production of ballast elements synthetic polymers or metal, including polyvinyl chloride, polyethylene, polystyrene, and aluminum, etc. may be especially advantageous due to their relatively low cost and good processibility, whereas for a home environment alternative materials, including wood may be more preferable. Furthermore, where especially heavy materials are desirable, metals such as lead, copper, or metal alloys including brass may be employed. When particularly light materials are required, foamed polymers, or balsa wood may advantageously be utilized.

With respect to the indentation in the ballast element it is contemplated that various indentations other than an indentation of approximately 4 cm length, about 0.5 cm width and about 0.5 cm depth are appropriate, so long as the indentation receives at least part of the launcher receiving element. For example, smaller ballast elements may have an indentation that measures about 1 cm in the longest dimension, while indentations in large ballast elements, and especially in ballast elements that extend along the leading edge, may be as long as 50 cm and more in their longest dimension. Contemplated indentations may have many shapes, including an oval, rectangular, or circular shape. Therefore, appropriate indentations are also not restricted to run substantially parallel to the leading edge.

In still other aspects of the inventive subject matter, the launcher receiving element may be various elements other than a hook, so long as the launcher receiving element is coupled to the ballast element, and comprises a catch with which at least part of the launcher has a mating fit. However, it should be especially noted, that the ballast element is not a launcher receiving element. Contemplated alternative launcher receiving elements may be button-shaped or comprise more than one hook.

It is still further preferred that the ballast element and the launcher receiving element are arranged on the wing of the flying toy such that the leading edge of the wing is substantially vertical when the flying toy is suspended from the launcher receiver element. The term "substantially vertical" as used herein includes deviations of less then 10° from an absolute vertical position. This particular arrangement has proven to impart superior flying characteristics to the toy. Other arrangements, however, are also contemplated, including vertical deviations of 5°–10°, 10°–15°, 15°–20°, and 20°–30°.

Figure 3:
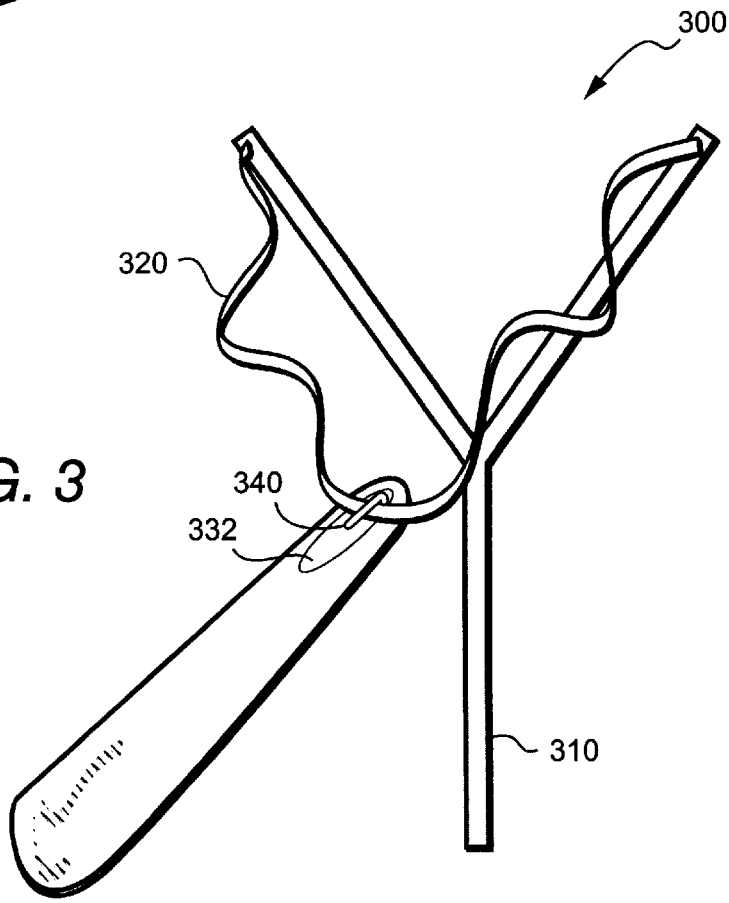
FIG. 3 is a perspective view of the flying toy of FIG. 1 in conjunction with a mechanical launching device according to the inventive subject matter.

In a further aspect of the inventive subject matter, a launcher comprises an elastic portion, which may include one or more than one rubber band, or a coil spring that is stretched or compressed to translate potential energy in the coil into kinetic energy. FIG. 3 shows an exemplary launcher 300 having a handle 310 and a rubber band 320 as an elastic portion.

In a game playing with the flying toy, a portion of the launcher is engaged with the launcher receiving element of the toy. While the toy is coupled to the launcher, the ballast element of the toy is pointed upwards, and the toy and launcher are pulled apart, thereby creating a tension force in the elastic element of the launcher. The toy is then released and the tension force in the launcher propels the toy in the air. After the toy reaches the apogee of its ascend, it will descend in a spiraling, maple seed-like flight pattern.

Thus, specific embodiments and applications of a mechanically launched monowing toy have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises", and "comprising", should be interpreted as referring to elements, components, or steps in a non-exclusive manner, indicating that the referenced elements, components, or steps may be present, or utilized, or combined with other elements, components, or steps that are not expressly referenced.

What is claimed is:

1. A flying toy, comprising:

a single wing having a leading edge, a first end, and a second end;

a allast element coupled to the first end of the wing and having an indentation; and a laucher receiving element that protrudes from the identation;

wherein the ballast element and the launcher receiving element are arranged on the wing such that the leading edge is substantially vertical when the flying toy is suspended from the launcher receiving element, and wherein the flying toy has a configuration that remains the same during launch and flight, and wherein the flying toy is configuration such that the flying toy descends in spiraling pattern.

2. The flying toy of claim 1 wherein the wing has a length L, and wherein L is between 5 cm and 100 cm.

3. The flying toy of claim 1 wherein the wing has a length L and a width W, wherein the ratio of L to W is between 10:1 and 3:1.

4. The flying toy of claim 1 wherein the wing further comprises a stabilizing element.

5. The flying toy of claim 1 wherein the wing comprises a material selected from the group consisting of a textile, a paper, and a synthetic polymer.

6. The flying toy of claim 1 wherein the leading edge has a substantially straight section of at least 2 cm.

7. The flying toy of claim 1 wherein the first and second ends are non-identical in shape.

8. The flying toy of claim 1 wherein the ballast element is non-spherical.

9. The flying toy of claim 8 wherein the non-spherical ballast element is tear-shaped.

10. The flying toy of claim 1 wherein the ballast element is separable into a top portion and a bottom portion.

11. The flying toy of claim 10 wherein a portion of the wing is disposed between the top portion and the bottom portion of the ballast element.

12. The flying toy of claim 1 wherein the ballast element has an indentation.

13. The flying toy of claim 1 wherein the launcher receiver element comprises a catch.

14. The flying toy of claim 13 wherein the catch comprises a hook.

15. The flying toy of claim 12 wherein the launcher receiver element is coupled to the ballast element within the indentation.

16. The flying toy of claim 1 wherein the ballast element and launcher receiver element are positioned on the wing such that the leading edge is substantially vertical when the flying toy is suspended from the launcher receiver element.

17. The flying toy of claim 1 wherein the flying toy has a shape that resembles that of a giant pericarp of a maple seed.

* * * * *